United States Patent [19]

Ebregt et al.

[11] Patent Number: 4,702,876

[45] Date of Patent: Oct. 27, 1987

[54] VARIABLE-APERTURE PROCESS FOR THE MANUFACTURE OF FILAMENTS FROM AROMATIC POLYAMIDES

[75] Inventors: Johan L. Ebregt; Hendrik Maatman, both of Arnhem, Netherlands

[73] Assignee: Akzo N.V., Netherlands

[21] Appl. No.: 754,364

[22] Filed: Jul. 11, 1985

[30] Foreign Application Priority Data

Jul. 11, 1984 [NL] Netherlands ..... 8402192

[51] Int. Cl.[4] ..... D01D 5/06

[52] U.S. Cl. ..... 264/184; 264/178 F; 264/179; 425/382.2

[58] Field of Search ..... 264/178 F, 184, 179; 425/131.5, 382.2

[56] References Cited

U.S. PATENT DOCUMENTS

| | | | |
|---|---|---|---|
| 2,228,155 | 1/1941 | Serinis . | |
| 3,002,804 | 10/1961 | Kilian | 264/178 F |
| 3,412,191 | 11/1968 | Kitajima et al. | 264/182 |
| 3,642,706 | 2/1972 | Morgan, Jr. | 264/184 |
| 3,767,756 | 10/1973 | Blades | 264/184 |
| 3,869,430 | 3/1975 | Blades | 264/184 |
| 4,078,034 | 3/1978 | Lewis | 264/184 |
| 4,308,374 | 12/1981 | Vollbracht et al. | 528/336 |
| 4,340,559 | 7/1982 | Yang | 264/184 |
| 4,374,978 | 2/1983 | Fujiwaro et al. | 264/184 |
| 4,419,317 | 12/1983 | Fujiwaro et al. | 264/184 |

FOREIGN PATENT DOCUMENTS

| | | |
|---|---|---|
| 021484 | 1/1981 | European Pat. Off. . |
| 0703114 | 4/1931 | France . |
| 1071888 | 4/1954 | France . |
| 7019413 | 7/1970 | Japan . |
| 60-65110 | 4/1985 | Japan . |
| 7502060 | 2/1975 | Netherlands . |
| 0344351 | 11/1929 | United Kingdom . |
| 0922485 | 4/1963 | United Kingdom . |
| 0979342 | 1/1965 | United Kingdom . |

*Primary Examiner*—Jan H. Silbaugh
*Assistant Examiner*—Hubert C. Lorin
*Attorney, Agent, or Firm*—Jeffrey S. Boone

[57] ABSTRACT

Fibers are air-gap spun from a polymeric spinning mass comprising an aromatic polyamide (such as poly-p-phenyleneterephthalamide) by extrusion through a spinneret, passing through an air-gap, passage through a liquid (such as water), and exiting the liquid via an aperture which is variable in size. The use of such an aperture allows easier use of the equipment (especially the stringing up operation) and better fibre properties (such as tensile strength).

18 Claims, 26 Drawing Figures

VARIABLE-APERTURE PROCESS FOR THE MANUFACTURE OF FILAMENTS FROM AROMATIC POLYAMIDES

BACKGROUND OF THE INVENTION

The invention relates to a process for the manufacture of filaments wholly or substantially consisting of aromatic para-positioned polyamides.

In a typical process, fibers are made from an aromatic polyamide such as poly-paraphenylene terephthalamide, polyparabenzamide, or poly-4,4'-diaminobenzanilide terephthalamide (4,4'-DABT), by spinning a spinning mass consisting of a mixture of concentrated sulphuric acid and, calculated on the weight of the mixture, 16 to 30% of the polymer with an inherent viscosity of 3,5 to 7 or higher, the spinning mass being extruded downwardly into a coagulation bath from a spinning unit provided with spinning orifices, of which spinning unit the outflow side is positioned in a gaseous, inert medium, preferably air, and at a short vertical distance, of, say, 2,5 to 25 mm, from the liquid surface of the coagulation bath, and the filaments are withdrawn from the coagulation bath followed by subjecting them to a few aftertreatments, such as washing, drying and/or winding. Poly-para phenylene terephthalamide will be referred to hereinafter as PPDT.

A process for the type indicated above is disclosed, among other places, in U.S. Pat. No. 4,078,034 and U.S. Pat. No. 4,340,559. Both said well-known process and the process according to the invention relate in part to the manufacture of PPDT filament yarns and/or fibres with a relatively high tensile strength and a high modulus of elasticity. After having been commercially available for several years, these yarns increasingly find application in various high-grade products on which high demands are made as far as physical properties and other qualities are concerned.

Examples of high-grade products include reinforcing cords for vehicle tyres, conveyor belts, cables, ropes, etc. On economic grounds it is desirable that the highest possible production capacity should be attained. To increase the speed of production of aramid yarn it has in the first place been proposed that the winding speed be increased, i.e. the speed at which the completed yarns are wound into the form of a package. However, as mentioned in U.S. Pat. No. 4,340,559, an increase in winding speed is attended with deterioration of the physical properties and the quality of the yarn, particularly when yarns composed of a large number of filaments are to be produced. It has now been found that these drawbacks to increasing the speed are due to the PPDT process being fairly critical; in particular as regards the relatively short height (typically 2,5 to 25 mm) of the air gap between the underside of the spinneret and the spinning bath level and the use of a relatively shallow coagulation bath, which generally has a depth of 15 to 40 mm. Consequently, at higher spinning speeds and, corresponding, higher winding speeds, the residence time of the freshly spun filaments in the air gap and in the bath will become very short. Another cause of said problems is that in the well-known spinning processes for PPDT a fairly deep funnel-shaped depression is formed at the point where the bundle of, say, 250 to 1000 filaments enters the bath, as can been in for instance FIG. I and IV of U.S. Pat. No. 4,340,559. The centre line of said depression coincides with the line connecting the centre of the spinning unit and the centre line of the bath outlet for the filaments. The higher the speed of the filament bundle, the greater will be the depth and the width of said depression. The formation of such a depression will give rise to a relatively great average increase in air gap and an average decrease in bath depth at the filament bundle. Further, there will be differences between the distances covered through the air zone and through the bath between the filaments on the outside and in the inside of the bundle.

In air gap spinning PPDT there is the problem that a considerable amount of the bath liquid usually consisting mainly of water and sulphuric acid will escape from the bath through the outlet opening for the freshly spun filaments positioned below the surface of the bath, which is particularly dependent on the height of the liquid column above the outlet opening. But the discharge of bath liquid through the outlet opening is to a very large extent effected in that the liquid is drained off along with and between the advancing filaments of a bundle via the outlet opening. This means that the amount of liquid entrained out of the bath along with the filament bundle will strongly increase with increasing winding speed from more than 350 m/min and up to 3000 m/min. Further, with a view to increasing the production capacity the number of filaments extruded into the bath at each spinning position will be increased as much as possible from more than 1000 to between 3000 and 10,000 filaments, which is another cause of a greatly increased amount of liquid being discharged from the bath through the outlet opening. The escape of large amounts of bath liquid through the outlet opening for the filaments will first of all make it necessary for an at least equally large amount of liquid to be re-fed to the bath or to be circulated. Moreover, said large stream of liquid via the outlet opening will result in the occurrence in the bath of undesirably high flow rates or turbulencies.

To diminish the amount of liquid discharged through the outlet opening it is possible in principle to reduce the area of the outlet opening. This has the disadvantage, however, that stringing up the filament bundle before re-starting the production process, for example after filament breakage, becomes a particularly difficult and time consuming operation, resulting in loss of production. This solution to the problem is all the more objectionable in that in the case of air gap spinning PPDT filaments the stringing up operation is in principle not simple at all because of the very limited space available below the spinneret and the emerging very agressive spinning solutions. With a known process it has been proposed before that stringing up be effected using an injector. Such a system, however, is complicated and not at all trouble-proof.

As far as the background of the state of the art is concerned reference is made to FR No. 1 071 888, GB No. 922 485, FR No. 703 114 and U.S. Pat. No. 2,228,155. They disclose the extrusion from the spinning unit of two or more separate groups of filaments of different materials for other spinning processes. Unlike the process of the present invention these well-known spinning processes do not relate to air-gap spinning, in which the extruded filaments first pass through an air zone and subsequently through a spinning bath. In other words, the spinning processes according to the above patent specifications do not relate to the air-gap spinning process, which is fairly critical for the spinning of poly-paraphenylene terephthalamide, particularly as regards the relatively small width of the air gap between the underside of the spinneret and the surface of the spinning bath of a relatively shallow coagulation bath. The spinning of two or more separate filament groups in the spinning processes according to said four disclosures is therefore not used for solving the PPDT air gap spinning problem of the undesirable formation of funnel-shaped depressions in the coagulation bath.

Reference is also made to Japanese Patent Specification publication No. 7 019 413, which describes a process for spinning fibres from polyacrylonitrile. In that case the spinneret is placed above the spinning bath at a distance from it of 1–10 mm and the object is to make filaments having an irregularly shaped cross-section, to which end the spinneret is provided with a large number, say 26, of groups of spinning orifices, each group counting for instance two or three orifices. The spinning orifices in each group are spaced at intervals of 0.1–0.7 mm, the distance between the groups being at least 1 mm. The irregular cross-sectional shape of the filaments is to be attributed to the fact that the two or three freshly extruded filaments in each group adhere to one another. This sticking together of filaments in the same group does not occur in the PPDT spinning process of the present invention and would lead to a qualitatively unacceptable product. The spinning process of said Japanese patent specification therefore greatly differs from the spinning process of the present invention. The envisaged effect of said Japanese patent specification, viz. sticking together of filaments, might prejudice a skilled man against applying the well-known process or at least a variant thereof, in the air gap spinning of PPDT.

One method of increasing the winding speed of the fibers during production is to use in the spinning mass a polymer which was produced by a process employing hexamethylphosphoramide as a solvent. The spinning mass will then have traces of this solvent (or its decomposition products), which apparently has lubricating effect during spinning, thus permitting higher winding speeds. However, hexamethylphosphoramide is generally considered to be a carcinogen, and it would be highly advantageous to provide a process for obtaining high winding speeds without its use.

SUMMARY OF THE INVENTION

In one aspect, the invention is an apparatus for air-gap spinning a plurality of distinct, separate fibers from an aromatic polyamide spinning mass, comprising (a) a forming means, including a spinneret; and (b) a contacting means for contacting the newly-formed fibers with a liquid, the contacting means including a container having a varible-aperture for with drawing the fibers.

In another aspect, the invention is the use of the aformentioned apparatus to air-gap spin a plurality of distinct, separate fibers from an aromatic polyamide spinning mass.

In yet another aspect, the invention is a method of air-gap spinning a plurality of distinct, separate fibers from a polymeric spinning mass comprising (a) forming an aromatic polyamide spinning mass into a plurality of fibers, (b) passing the fibers through an air-gap, and (c) passing the fibers through a liquid which is held in a container having a variable apparature for withdrawing the fibers.

In yet another aspect, the invention is a fiber produced by one of the aformentioned methods.

The use of various embodiments of the invention permits the manufacture of fibers having excellent properties. The invention allows the use of manufacturing processes involving high winding speeds, large numbers of filaments, high washbath acid concentrations, and/or other generally deleterious parameters, while maintaining or increasing fiber properties such as tensile strength. The invention also allows the use of high winding speeds without the use of hexamethylphosphoramide.

DETAILED DESCRIPTION OF THE INVENTION

Unless otherwise specified, the numerical limitations expressed herein are not critical. That is, they may be read as if they were prefaced with the word "about" or "substantially".

In the following description, a discussion of the major aspects of the invention is followed by a discussion of several preferred embodiments of the invention.

Referring generally either the apparatus or process aspects of the invention, the practice of the invention contemplates the air-gap spinning of an aromatic polyamide spinning mass.

By "air-gap spinning", is meant a process distinct from "wet spinning" in which the newly-formed fibers (more technically the fibers undergoing formation) pass through an air-gap prior to passing through a liquid bath. Although the word "air" is used, any substantially inert gaseous medium (eg: nitrogen), or even a non-coagulating liquid, may be used.

By the term "aromatic polyamide spinning mass" is meant a polymer comprising an aromatic polyamide, preferably at an elevated temperature and/or (preferably "and") with a solvent or solvents. In a most preferred embodiment the solvent is sulphuric acid. In preferred embodiments the aromatic polyamide is an aromatic parapolyamide, more preferably poly-p-phenyleneterephthalamide or poly-4,4'-diaminobenzanilideterephthalamide. Preferably, the spinning mass is free of hexamethylphosphoramide or its decomposition products.

The spinning mass is extruded through a spinneret to form a plurality of distinct, separate fibers. These "newly-formed" fibers, or "fibers under formation" pass through the air-gap (described above) into a liquid held in a container. The liquid is desirably water containing sulphuric acid; the sulphuric acid being present in the water because of recycling of the water due to environmental concerns.

When the fibers enter the water bath, the water removes most of the sulphuric acid and "coagulates" the fiber from a viscous liquid to a solid. The fiber then exit the container via an apparature which is variable in size. That is, the apparature is openable to a first, large open area for beginning the spinning operation and is reducable to a second, small open area for continuing the spinning operation.

The means for achieving the changing size of the apparature is desirably by the relative movement of two adjacent parallel plates, each having an aperture, wherein at least one of the plates may be slideably moved within its plane, such that the apparature in the two plates are generally alligned for the first, large open area and are generally misalligned for the second, small open area. Preferably, this relative movement is rotation about an axis perpendicular to the plane of the plate. More preferably, both plates are moved, in counter rotation to one another.

In another embodiment, the means for acheiving the variable size of the aperture is a hollow elastic ring (ie: shaped similar to a tiere inertube), the open center of which may be reduced in size by increasing the pressure inside the tube. In another embodyment the aperture is constructed in a manner similar to the diaphragm of a camera lens.

In other preferred embodiments described more fully hereinafter, modifications such as dividing the orifices of the spinneret into a plurality of separate zones, and passing the fibers of each spinneret zone through a separate variable-sized apparature, are made. While these embodiments are not critical to the practice of the invention in its broadest sense, they complement the broadest aspects of the invention and in combination yield a system which is commercially feasible, practical, and economically competitive.

The process in which the spun PPDT filaments are discharged from the bath through an outlet opening positioned below the surface of the bath is characterized according to the invention in that the area of each outlet opening for the discharge of the filaments from the spinning bath can be adapted to the spinning conditions. More particularly, each large outlet opening used during the stringing up operation is upon completion thereof reduced in area without interrupting the spinning process. According to the preferred embodiments of the invention the area of the outlet opening used during stringing up is desirably 5 to 25 times, preferably about 15 times the area upon completion of stringing up. A preferred embodiment of the process according to the invention is characterized in that after completion of stringing up, i.e. during the normal spinning process, use is made of an outlet opening whose area is in the range of 100·A to 5000·A, preferably 500·A to 1500·A, A being the total cross-sectional area in the wound state of the filament bundle discharged through the outlet opening.

The invention also comprises an apparatus for carrying out the process according to the invention, which apparatus is essentially characterized in that the passage provided by the opening or openings through which the freshly spun filaments are discharged from the bath is adjustable.

By applying the process according to the invention the spinning process can be readily started when the outlet opening for the discharge of the filament bundle from the bath is set to its highest value. It will then be possible for the relatively large number, for example from a few hundred up to a few thousand, of spun filaments to be worked from the bath into the relatively large outlet opening. As soon as the filaments emerge from the spinning tube connecting with the outlet opening, they can be placed on the various guiding and transporting elements and be passed through appropriate washing and drying equipment and finally wound up. When all filaments are in their proper position, the speed of the filaments as they pass through the apparatus is gradually increased to the desired spinning and winding speed during normal operation, while said outlet opening or openings for the discharge of the filaments from the bath is (are) very much reduced in area. As the area of the outlet opening(s) is reduced to a minimum, the amount of liquid flowing out of the bath will in the process of the invention also be reduced to a minimum. Consequently, only relatively little liquid need be fed to the bath, so that a constant and steady flow of liquid can be maintained in the bath practically without any attendant undesirable turbulences, which is of benefit to the quality of the filaments. Since relatively little bath liquid is discharged through the small outlet opening, also the formation at the filament bundles of a funnel-shaped depression in the bath will be further reduced. When the total filament bundle extruded from the spinneret into the bath is divided into a plurality of groups, it is preferred according to the invention that these groups should each be separately discharged from the bath through their own outlet openings, the area of each of the said outlet openings being greatly reduced upon completion of the stringing up operation. The process according to the invention also permits a considerable increase in spinning speed and winding speed being realized without detracting from the quality of the yarn produced. Particularly when applying high winding speeds, the process according to the invention offers the great advantage that in the event of filament breakage the yarn can rapidly and readily be strung up again, so that loss of production and the formation of waste yarn is reduced to a minimum.

The process according to preferred embodiments of the invention is characterized in that the filament-bundle, which in all comprises at least 100 filaments, divided into two or more separate, spaced groups is extracted from the spinning unit into the coagulation bath. In a favourable embodiment of the process according to the invention it is preferred that in the spinning unit the two or more filament groups should be extruded into the coagulation bath from a single spinneret. According to preferred embodiments of the invention the groups each comprise at least 50 filaments and are so arranged that of adjacent filament groups the smallest distance between the outermost filaments of the one group and the outermost filaments of the other group is at least 10 mm, measured at the spinneret. According to preferred embodiments the invention the filaments can in a simple manner be extended via the air gap into the coagulation bath in three to eight groups, preferably four to six groups, each group comprising 100 to 3000 filaments, preferably about 200 to 600 filaments. A particularly effective embodiment of the process according to the invention is characterized in that the extruded filament groups are substantially arranged in a discontinuous annular zone concentrical with the centre of the spinneret, each filament group comprising 2 to 20, preferably 6–12, practically concentric rows of filaments and the distances between the successive rows and the centre-to-centre distances of the filaments in the rows are in the range of about 0.4 to 1 mm, preferably about 0.5 to 0.8 mm.

Also in the case of a preferred the embodiment of to the invention in which the successive filament groups are arranged in a discontinuous annular zone the smallest distance between the outermost filaments of the one group and the outermost filaments of the other group is at least about 10 mm, preferably however 15 to 35 mm, and the discontinuous annular zone in which the filament groups are arranged has an inner diameter of 20 to 45 mm, preferably about 40 mm, and an outer diameter of 50 to 70 mm, preferably about 60 mm.

A particularly favourable embodiment of the process according to the invention is characterized in that in the spinning unit each of the two or more filament groups is extruded from its own spinneret into one and the same coagulation bath from which they are discharged collectively. When according to these preferred embodiments of the invention 2–8 separate filament groups are collectively extruded then from the spinning unit, these filament groups are extruded through 2–8 respective spinnerets in one and the same spinning unit. It is preferred that the filaments of each group should form a substantially circular pattern.

The process according to the invention is also preferably characterized in that the bundle extruded from the spinning unit into the coagulation bath comprises more than 1000, preferably 1500–3000, filaments. It has been found that by applying the principle according to the preferred embodiments of the invention of a plurality of separate filament groups per spinning unit, also a filament bundle comprising said last-mentioned large numbers of filaments can be obtained using one spinning unit while maintaining the favourable quality level of the yarn.

Another important characteristic of the process according to the preferred embodiments of the invention consists in that said filament groups are extruded into an aqueous coagulation bath containing 5–50 percent by weight of sulphuric acid and about 95 to 50% by weight of water. More desirably, the sulphuric acid concentration in the bath is 10–30% by weight, and preferably about 15–25% by weight. Hitherto the skilled man has had the impression that spinning PPDT into a coagulation bath having a relatively high sulphuric acid concentration, i.e. higher than about 5% by weight, would lead to a yarn with less favourable physical properties if there were, for example, more than 250 fibers being spun. Surprisingly, it has been found that by applying the principle according to the preferred embodiments of the invention of a plurality of separate filament groups per spinning unit, a yarn with favourable properties will be obtained also when use is made of said higher sulphuric acid concentration in the bath. This is of importance partly because by spinning into a concentrated bath a simpler and more economical way is obtained of recovering and re-using and sulphuric acid. Recovery of the sulphuric acid is also of great importance for environmental reasons. For, even if neutralized, if instead of being recovered the spinning bath is drained into the sewerage system, the large quantities of sulphuric acid involved will cause great environmental pollution.

The formation in the bath at a point below the middle of the spinneret or in the centre of the entire filament bundle of said deep funnel-shaped depression is distinctly inhibited by dividing the total number of filaments leaving a spinneret into two or more groups, which same number of groups or bundles pass through the air gap before entering the coagulation bath. In the process according to the invention the use of, say, two, three, four or more separate groups or bundles is hardly attended with the formation of depressions or a lowering of the bath level or only such minor lowering thereof in the corresponding two, three, four or more places of the bath as will not interfere with the spinning process. Consequently, the increase in air gap and the decrease in distance covered through the bath as a result of raising the winding speed at a value of more than 350 m/min when applying the process according to the preferred embodiments of the invention will be so small that they will not have any appreciable effect on the properties of the yarn obtained. Moreover, because of the absence in the process according to the preferred embodiments of the invention of appreciable formation of depressions in the bath liquid there will no longer be any differences in the distances covered in the air gap and the spinning bath between the outermost and the innermost filaments of a filament group. This is of importance considering that the tensile strength of the filaments decreases with increasing air gap.

Surprisingly, it has been found that in the process according to the invention the filaments will less readily stick together. Also as a result of this the physical properties of the yarn will be improved and a more homogeneous yarn will be obtained. That the filaments in the yarn made by the process of the invention will hardly stick together is particularly manifest in non-twisted PPDT yarns.

The favourable effects of the process according to the invention can still be considerably enhanced when the spun filaments are discharged from the bath through an outlet opening positioned below the liquid surface of the coagulation bath and the process is characterized in that the filament groups are separately discharged from the coagulation bath through their own outlet openings. When for example four groups of filaments are extruded from the spinneret into the coagulation bath via the air gap, these four groups are discharged through four respective holes in the bottom of the bath. Each of the four holes will, of course, be chosen as small as possible, also in view of limiting the amount of bath liquid leaving the bath through these openings, and will therefore always be smaller than a single central discharge opening for all filaments. Use of more than one discharge opening for the filaments in the bottom of the bath also contributes to the absence of appreciable formation of depressions in the bath surface. Also the sticking together of filaments is even further reduced as a result of discharging two or more filament groups through two or more respective outlet openings in the bottom of the bath.

The filament groups may also be separately passed through a spinning tube connecting with the bath outlet openings for the filament groups; at the outlet end of the spinning tube the filament groups are separately advanced over one or more yarn guiding elements.

As mentioned hereinbefore, the number of outlet openings and their position according to the invention play an important role in avoiding said unfavourable formation of depressions in the surface of the coagulation bath.

In all embodiments of the invention it is highly desirable that the fibers be as verticle as is possible. This is facilitated by having the orifices of the liquid container generally directly underneath the corresponding spinneret zones. The absence of this generally verticle arrangement will cause a decrease in tenacity.

BRIEF DESCRIPTION OF THE DRAWINGS

The invention will be further described with reference to the accompanying schematic drawings.

In FIGS. 20, 22, 24 and 26 the hatched parts each correspond to a filament group.

DETAILED DESCRIPTION OF THE DRAWINGS

Figure 1:
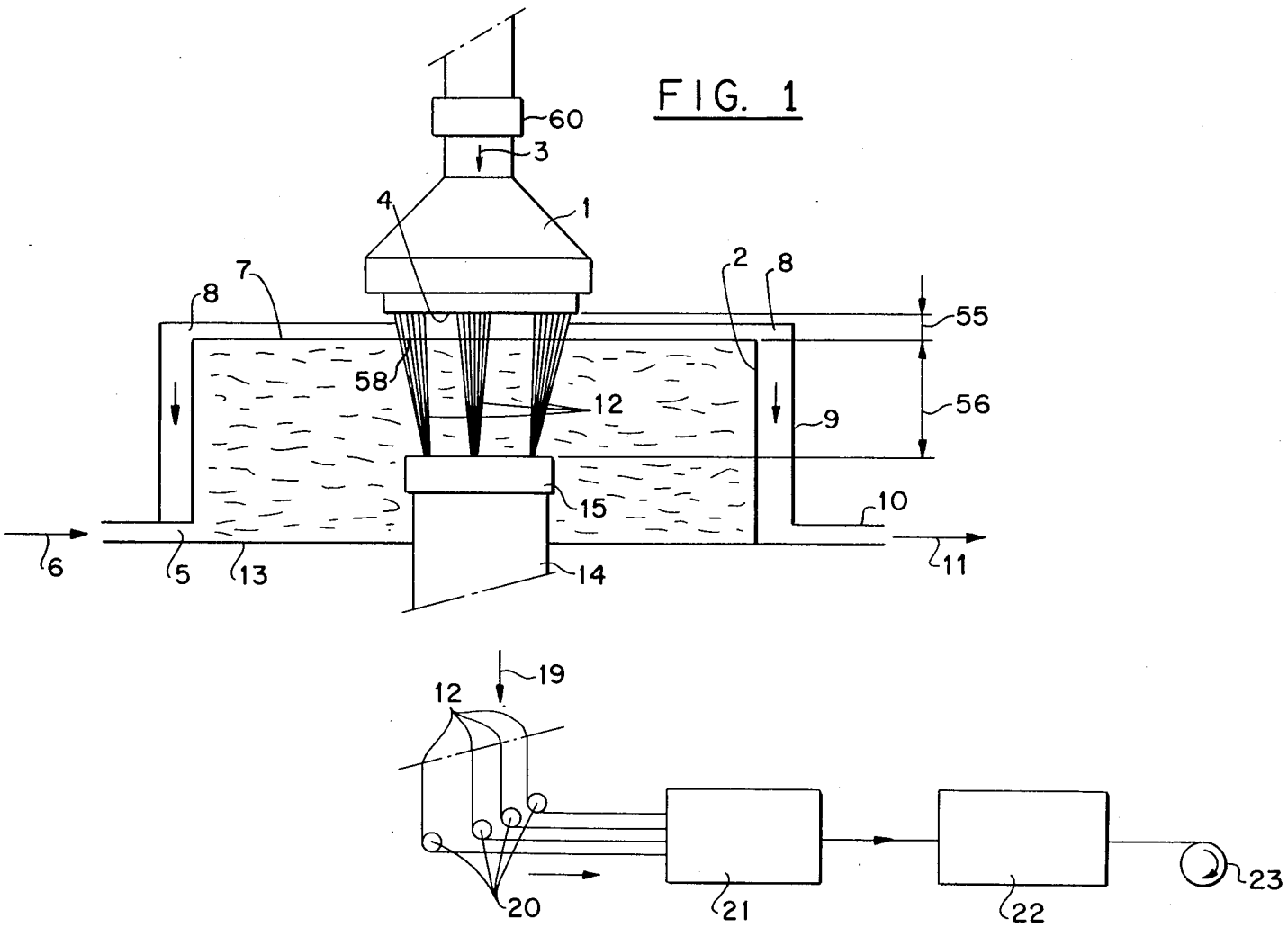
FIG. 1 is a schematic representation of a PPDT spinning process.

In FIG. 1 a spinning unit 1, which is fixed in a frame (not shown), is positioned over a coagulation bath 2. To the spinning unit 1 the solution to be spun is fed by a feed pump 60 in the direction indicated by arrow 3. The spinning unit 1 is provided with a spinning assembly (not shown) comprising one or more filters and at its underside a spinneret 4, which is represented on an enlarged scale in FIG. 2.

The coagulation bath 2 is provided with an inlet 5 to which a bath liquid mainly consisting of water and sulphuric acid is fed in the direction indicated by arrow 6. The liquid in the bath 2 is continuously kept at the same level 7 by feeding more bath liquid through the inlet 5 than is necessary. The surplus bath liquid is discharged into a space bounded by a jacket 9 through overflow openings 8 provided in the wall of the bath at level 7. The jacket 9 is provided with an outlet 10 for discharging the liquid in the direction indicated by arrow 11.

Figure 2:
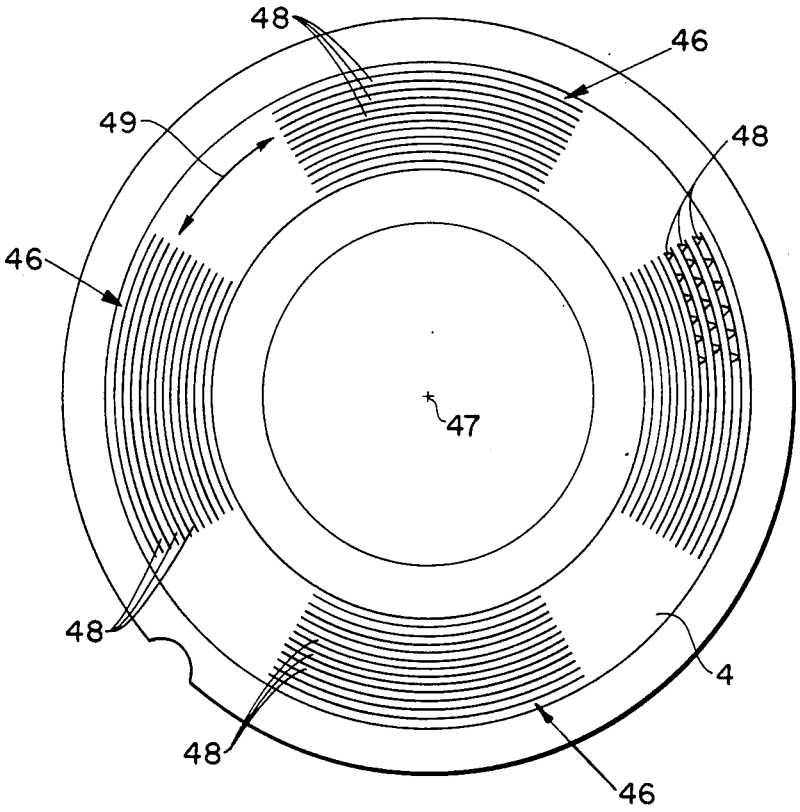
FIG. 2 is a view of a spinning unit comprising one spinneret for four filament group to be used in carrying out the process of the invention.
Figure 4:
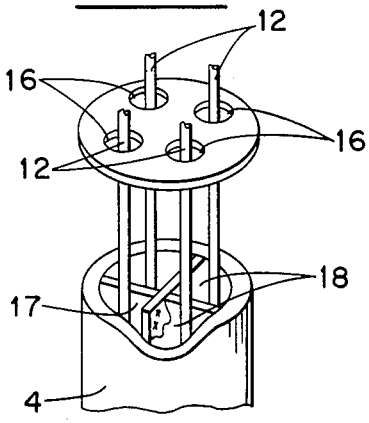
FIG. 4 is a view in perspective of an embodiment of a spinning tube.

The filament groups, numbering four in FIGS. 1 and 2, extruded from a spinneret 4 in the form of an annular plate, are referred to by the numeral 12. Near the bottom 13 in the bath 2 is a spinning tube 14, which is provided with an assembled lid 15 with four openings 16 (see FIG. 4) for allowing the passage of four groups 12 of spun filaments. The details of the variable size openings are not shown in FIGS. 1–4. The vertical distance between the underside of the spinneret 4 and the upper side of the spinning tube is divided into two zones which are very essential to the spinning process, viz. the air gap and the liquid column above the spinning tube, of which the heights are referred to by 55 and 56, respectively, and which in actual practice have a width of about 2.5 to 25 mm and 15 to 40 mm, respectively. The spinning tube 14 is divided into four channels 18 by means of crossing partitions 17, so that each filament group 12 runs into the spinning tube 14 through its own channel. In the spinning tube the filament groups 12 move downwards along with some amount of entrained bath liquid in the direction indicated by the arrow 19. The lower part of the spinning tube 14 is left out in FIG. 1. Below the spinning tube 14 are four yarn guiding elements 20, over which each of the filament groups is passed and after being combined, if required, passed to schematically indicated washing equipment 21 and subsequently to a drier 22. Finally, the yarn is wound into a package 23.

Figure 5:
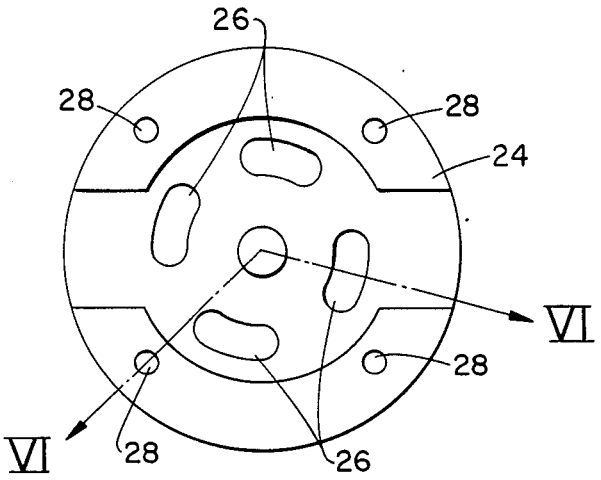
FIGS. 5–14 show an embodiment for the adjustable outlet openings through which the filaments are discharged from the spinning bath.
Figure 6:
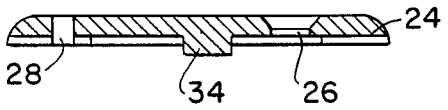
Figure 7:
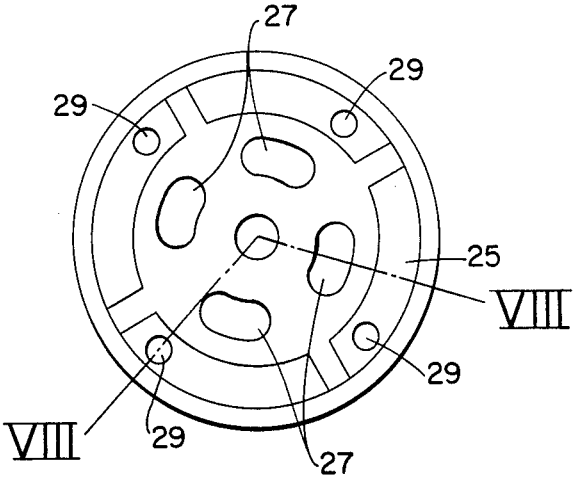
Figure 8:
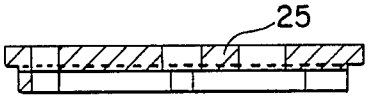

FIGS. 5 to 14 inclusive are detached views of the variable apertures of the lid 15 of the spinning tube. FIGS. 5 and 6 are respectively a plan view and a cross-sectional view along the line VI—VI of the upper plate 24 of the lid 15. FIGS. 7 and 8 are a plan view and a cross-sectional view along the line VIII—VIII, respectively, of the lower plate 25 of the lid 15. The upper plate 24 and the lower plate 25 (FIG. 7) are so fitted in the lid 15 that the four relatively large outlet openings 26 and 27, respectively, for the filament groups 12 are in line with each other. The plates 24 and 25 are rigidly attached to each other by means of screws provided in the holes 28 and 29, respectively. Between the upper plate 24 and the lower plate 25 are two thin, metal diaphragm plates 30 (FIGS. 9 and 12) and 31 (FIGS. 10 and 13), which are shown in FIGS. 9–14. The diaphragm plates 30 and 31 are provided with central holes 32 and 33, respectively, as a result of which they can be turned through a limited angle on a central stud 34 of the upper plate 24. To make the angular displacements in the directions indicated by the arrows 35, 36, 37 and 38 the diaphragm plates 30 and 31 are provided with a lug 39 and 40, respectively. As appears especially from FIGS. 9, 10, 12 and 13, the two diaphragm plates 30 and 31 each also have four relatively large passages 41 and 42, respectively. Each of the large passages 41 and 42 in the diaphragm plates 30 and 31 is provided at one end with a semi-circular extension 43 and 44, respectively.

Figure 11:
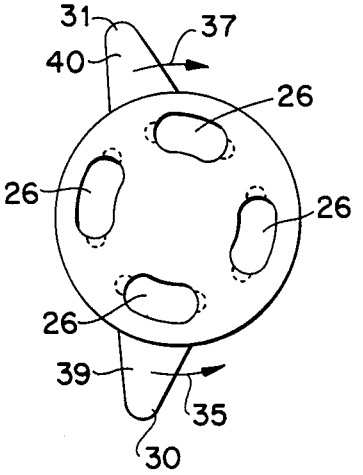
Figure 14:
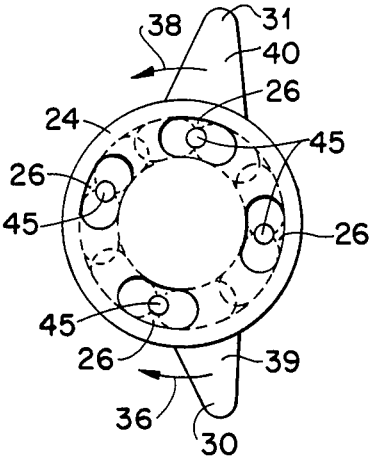

FIG. 11 and FIG. 14 are plan views of the complete lid 15 of the spinning tube 14, the lid being made up of the upper plate 24, the lower plate 25 with between them the two rotatably mounted diaphragm plates 30 and 31, as far as visible.

FIG. 11 shows the situation in which the diaphragm plates 30 and 31 are so rotated relative to each other and relative to the upper plate 24 and the lower plate 25 that the relatively large openings 26 permit the completely free passage of the four freshly spun filament groups 12 during stringing up. Operating rods (not shown) attached to the lugs 39, 40 of the diaphragm plates 30 and 31, respectively, may be used to turn the diaphragm plates 30 and 31 through an angle of a few dozen degrees on the stud 34 in the directions indicated by the arrows 35 and 37, respectively. This angular displacement of the diaphragm plates 30, 31 results in the situation shown in FIG. 14, in which for the passage of the four filament groups 12 only the relatively small openings 45 are left. The openings 45 are each formed by the nose-shaped extensions 43 and 44 of the large openings 41 and 42, respectively, in the diaphragm plates 30, 31. The latter position of the diaphragm plates with the relatively small passage 45 for the four filament groups will prevail during normal operation of the spinning process, i.e. upon completion of stringing up.

Figure 10:
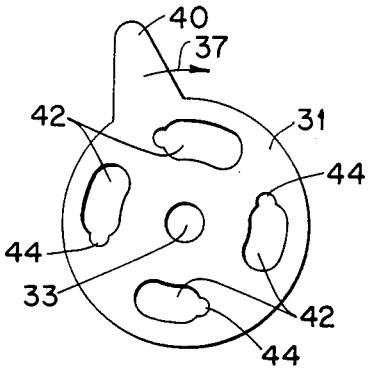
Figure 13:
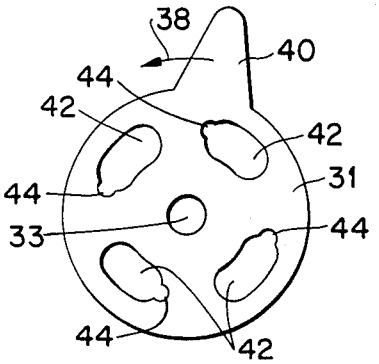
Figure 9:
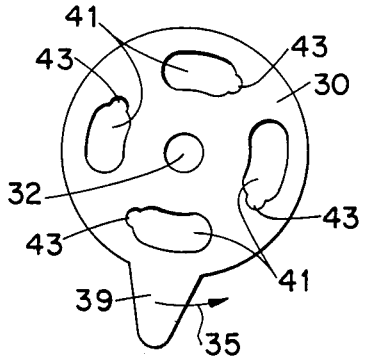
Figure 12:
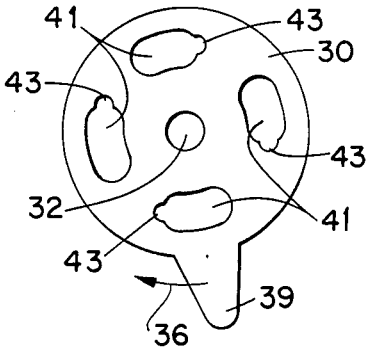

For further illustration the diaphragm plates 30 and 31 in their stringing up position in FIG. 11 are separately shown in FIGS. 9 and 10, respectively. The diaphragm plates 30 and 31 in their normal spinning position of FIG. 14 are also separately shown in FIGS. 12 and 13, respectively.

As mentioned hereinbefore, the embodiments shown in FIGS. 1 to 14 of an apparatus for carrying out the process according to the invention are destined for extruding from the spinneret 4 a number of spaced, separate filament groups 12. The disposition of the four filament groups 12 can be derived particularly from the inverted plan view shown in FIG. 2. FIG. 2 shows that the four filament groups 12 are extruded through four corresponding groups of orifices 46 which are arranged in a discontinuous annular zone around the centre 47 of the plate-shaped spinneret 4. The entire spinneret 4 contains 2004 orifices measuring, for example, 0.065 mm in diameter, which are arranged in 13 concentric rows 48 which are spaced, in radial direction, at intervals of 0.5 mm. The 13 rows of orifices therefore take up a total radial width of $12 \times 0.5 = 6$ mm. The innermost rows of orifices are positioned on a circle 44 mm in diameter and the outermost rows of orifices are on a circle 56 mm in diameter. In the innermost rows the orifices are positioned at centres of over 0.05 mm and in the outermost rows at centres of over 0.65 mm. The total bundle of 2004 filaments is extruded from the spinneret into the spinning bath in four separate spaced groups of 501 filaments each. In view of pressure resistance a field of spinning orifices 46 (FIG. 2) will generally not be wider in radial direction than 15 mm, preferably not more than 6–10 mm.

In this embodiment the length of the large passages during stringing up is was about 17 mm and the width about 10 mm. In normal spinning operation (FIG. 14) the passages are practically circular and have a diameter of about 4 mm.

In the embodiment shown in FIGS. 1 and 2 with four filaments groups 46 each consisting of 501 filaments the smallest distance between the outermost filaments of adjacent filament groups is referred to by the numeral 49. In reality said smallest distance is about 17 mm, measured at the spinneret, with a spinneret of the above dimensions and arrangement of orifice patterns. In the zone with the spinning orifices the spinneret shown in FIG. 2 may have an outwardly curved surface.

Figure 15:
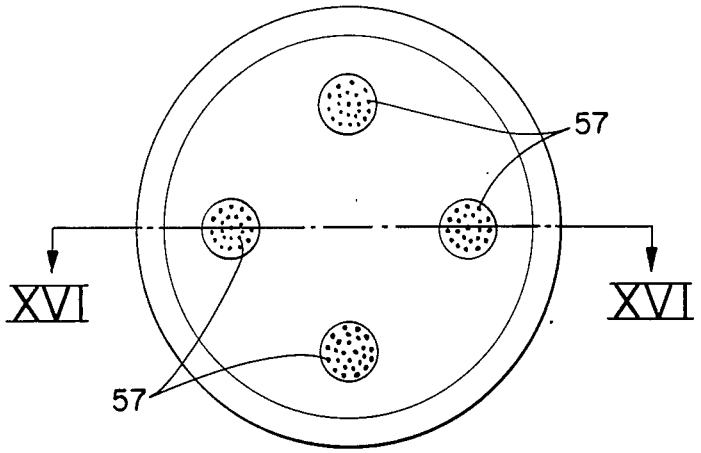
FIG. 15 is a view of a spinning unit with a spinneret for each of the four groups of filaments.
Figure 16:
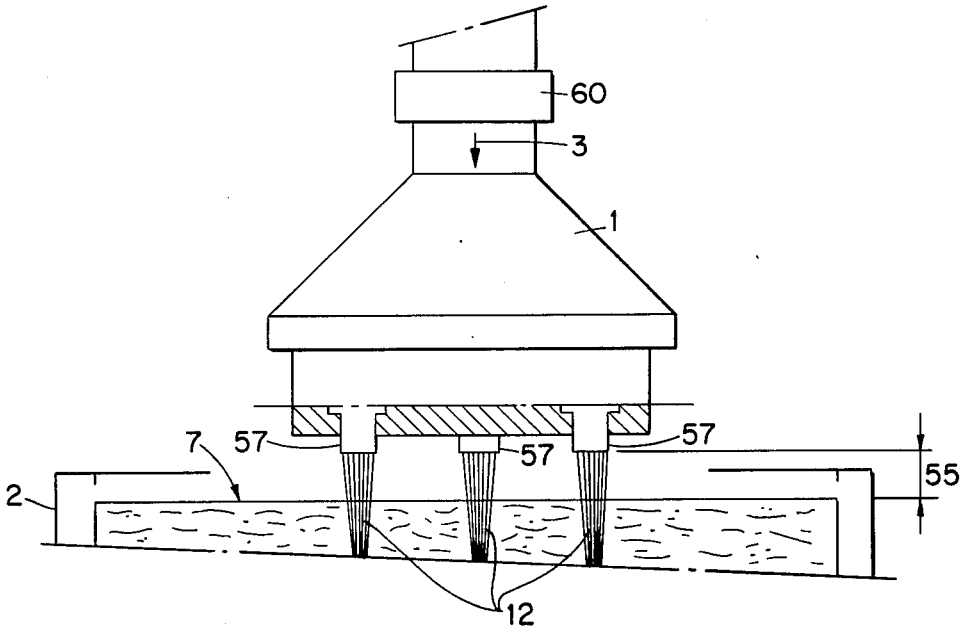
FIG. 16 is a view partly in cross-section along the line XVI—XVI in FIG. 15.

FIGS. 15 and 16 show a somewhat varied embodiment of the spinning unit according to the invention, corresponding parts being referred to by like numerals. Instead of the four fields of spinning orifices 46 drawn in the single, annular spinneret 4 of FIG. 2 the spinning unit 1 shown in FIGS. 15 and 16 contains four separate, small spinning jets 57.

If with this spinning unit also a filament bundle with in all 2004 filaments are to be made, then each small spinning jet 57 should be provided with 501 orifices. From each spinning jet 57 a group of 501 filaments can be spun then. The four filament groups 12 are each extruded then from their own spinning unit 57 and pass, via the air gap 55, into the coagulation bath 2. The resulting four filament groups 12 can be collectively discharged through a spinning tube (not shown in FIG. 16) and after treated in the same way as described hereinbefore for the four filament groups 12 which are extruded through the large annular spinneret 4 with four fields of spinning orifices 46. As a result of the division of the total filament bundle into four groups there will be no formation either of a deep funnel-shaped depression in the bath surface when use is made of the apparatus according to FIGS. 15 and 16.

At a high speed and a relatively large number of filaments per group there will be only a relatively small lowering of the bath level 7 at the point where each of the four filament groups 12 enters the bath. This lowering of the bath level in places may, of course, be reduced by using more filament groups with fewer filaments per group.

Figure 3:
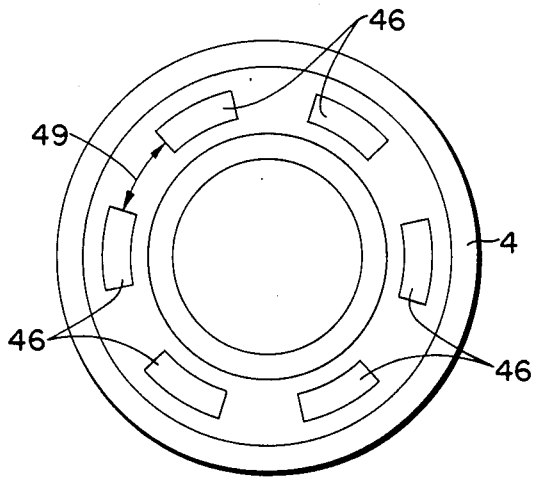
FIG. 3 shows one spinneret for spinning six groups of filaments.

FIG. 3 shows a plate-shaped spinneret 4 which somewhat differs from the one in FIG. 2, corresponding parts being referred to by like numerals. The spinneret 4 according to FIG. 3 contains 6 orifice groups 46, which are arranged in a discontinuous annular zone around the centre 47. The distance between the adjacent groups is again referred to by the numeral 49. If a bundle of in all, say, 1998 filaments is to be made, each orifice group 46 should be made of 333 spinning orifices. The six filament groups 12 will be extruded into the coagulation bath 2 via the air gap 55.

Figure 18:
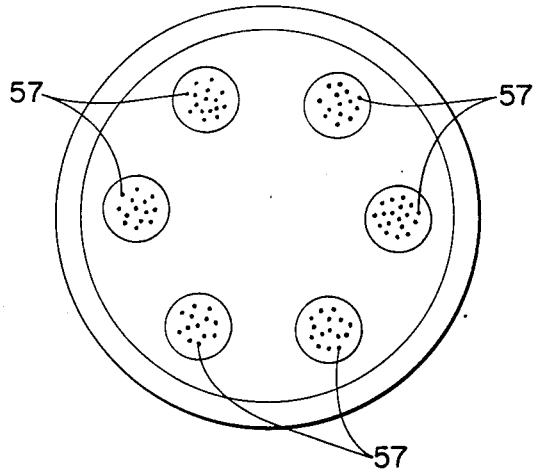
FIG. 18 shows a spinning unit with a spinneret for each of six groups of filaments.
Figure 17:
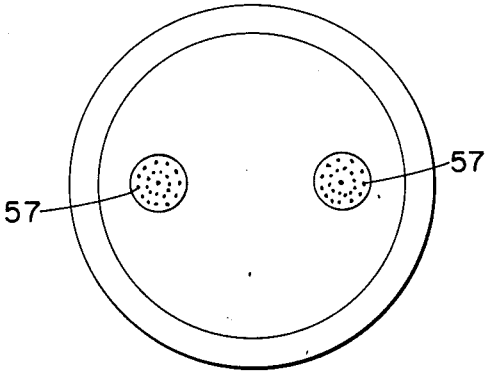
FIG. 17 shows a spinning unit with a spinneret for each of two groups of filaments.

FIGS. 17 and 18 show a few variant embodiments which are mainly of the type shown in FIGS. 15 and 16. In FIGS. 17 and 18 corresponding parts are again referred to by like numerals. The embodiment shown in FIG. 17 differs from the one in FIG. 15 in that only two separate, small spinning jets are contained in the spinning unit 1. The embodiment according to FIG. 18 differs from the embodiment shown in 15 in that six separate, small spinning jets 57 are contained in the spinning unit 1.

The invention will be further described in the following examples.

PREPARATION OF THE POLYAMIDE

Poly-p-phenylene terephthalamide is prepared from p-phenylene diamine and terephthaloyl dichloride. As reaction medium a mixture of N-methyl-pyrrolidone and calcium chloride is used. The preparation is effected in the same way as described in Example VI of Netherlands patent application No. 7 502 060, but on a larger scale. Coagulation of the resulting polymer is effected by adding to the reaction mixture, with vigorous stirring, 10 kg of water per kg of polymer formed.

The resulting polymer suspension is filtered off, washed, and dried at 120° C. A powdered product is obtained having a maximum particle size of 1.5 mm.

The inherent viscosity of the resulting poly-p-phenylene terephthalamide is 5.3 dl per gram.

MANUFACTURE OF THE FILAMENTS

Liquid sulphuric acid of a concentration of 99.8% by weight is applied to the surface of a rotating roll which is internally cooled to −10° C. with brine. On the roll surface a thin layer of solid sulphuric acid is formed. This layer is scraped off in the form of flakes. The solid sulphuric acid is transferred to a cone mixer (Nauta Mixer) provided with a cooling device, in which mixer the temperature is kept at a value about 10° C. below the solidifying point of the sulphuric acid. Subsequently, the poly-p-phenylene terephthalamide prepared in the above-described way is added to the solid sulphuric acid in an amount of 1 kg of polymer per 4.25 kg of solid sulphuric acid. This corresponds to 19% by weight of poly-p-phenylene terephthalamide, calculated on the total weight of sulphuric acid and polyamide together. Polyamide and solid sulphuric acid are thoroughly mixed for 30 minutes to form a homogeneous, solid, powdered mixture. In the mixing operation the temperature is kept at about 10° C. below the solidifying point of the sulphuric acid. With continued mixing the temperature of the mixture is allowed to rise to above the solidifying point of the sulphuric acid. In this way a granular, homogeneous mixture is obtained, which is subsequently deairated and heated to spinning temperature in a single screw extruder. This process is known and described, among other places, in Example I of Netherlands Patent Application No. 7 904 495 (European Patent No. 021 484). The temperature in the extruder is kept at 93° C. The total residence time of the liquid spinning mass at 93° C. up to its being spun is about 20 minutes. From the extruder the liquid spinning mass is via a filter and a spinning pump pumped to a spinneret 4 of the type indicated in FIG. 2. The spinneret 4 is provided with in all 1000 spinning orifices each measuring 60 μm in diameter and divided into four groups 46 of 250 orifices each. The spinning mass leaves the spinning orifices and subsequently passes through an air gap 55 measuring 8 mm in height, after which it is passed into a coagulation bath 2 of a 5% by weight-aqueous solution of sulphuric acid of about 10° C. The resulting filaments are successively thoroughly washed with a dilute NaOH solution and water, dried in a drum heated to 120° C. and wound up at a speed of 350 m/min.

The resulting filaments have been made by two different methods A and B according to the invention.

In the case of method A all 1000 filaments divided into four groups of 250 emerging from the spinning unit are discharged from the spinning bath through a single outlet opening 22.7 mm in diameter and, hence, measuring 405 $mm^2$ in area. The filaments are discharged through the spinning tube attached to the bottom of the coagulation bath.

In the case of method B all 1000 filaments divided into four groups of 250 emerging from the spinning unit are discharged from the spinning bath through four outlet openings each measuring 12 mm in diameter and, hence, 452 $mm^2$ in the area. The filaments are discharged through the spinning tube attached to the bottom of the coagulation bath.

The table below gives the additional test conditions and the yarn properties obtained with the methods A and B.

| | yield of spinning mass in kg/h | $\eta_{inh}$ PPDT | linear density in dtex/number of filaments | tenacity mN/tex | elong. at rupture | LASE 1% N |
|---|---|---|---|---|---|---|
| Method A 1 outlet opening | 17,5 | 5,3 | 1759/f 1000 | 1814 | 3,42 | 78 |
| Method B 4 outlet openings | 17,5 | 5,3 | 1748/f 1000 | 1842 | 3,28 | 88 |

As appears from the table, the methods A and B according to the invention both result in yarns with good properties. The properties of the yarns obtained by method B are somewhat better, which was to be expected because of the more favourable discharge of the spun filaments through four outlet openings in the bath.

Experiments have also been made using the methods C and D according to the invention in order to find out the influence of adjustable and non-adjustable outlet openings for the discharge of the filament groups from the bath. Both with method C and method D 1000 filaments divided into 4 groups of 250 are extruded from a single annular spinneret into the coagulation bath. With both methods the discharge of the four filament groups from the bath is through four respective openings in the lid of the spinning tube. And with both method C and method D the total filament bundle was wound up at a speed of 300 m/min. With method C each of the four discharge openings has a constant area of 50 $mm^2$ in a plate with a thickness of 2 mm. With methodd D the area of each of the four outlet openings is variable with the aid of diaphragm plates 30, 31 (see FIGS. 9–14). With method D each outlet opening measured 200 $mm^2$ during stringing up, upon completion of which the area of each of the outlet openings was reduced to 25.5 $mm^2$.

The table below gives the additional test conditions and the yarn properties obtained with the methods C and D.

| | $\eta$ ihn. kg/h | total amount of bath liquid discharged through the 4 openings upon completion of stringing up | linear density in dtex/number of filaments | tenacity mN/tex | elong. at rupture | LASE 1% N | stringing up |
|---|---|---|---|---|---|---|---|
| Method C constant outlet opening 50 $mm^2$ | 5,3 | 1606 | 1747/f 1000 | 1892 | 3,18 | 95 | difficult |
| Method D adjustable outlet 200–25,5 $mm^2$ per outlet | 5,3 | 1060 | 1728/f 1000 | 1930 | 3,32 | 87,5 | very easy |

Upon comparison of the physical properties of the yarns obtained by the methods C and D it appears that they do not show great differences. A great advantage to method D is that stringing up is very easy and the amount of bath liquid discharged through the outlet openings and hence to be recirculated is much lower than in the case of method C.

Following is a description of a few experiments in which the filament bundles were divided into groups and use was made of a variable outlet opening in the coagulation bath (so-called diaphragm system), which arrangements resulted in considerable improvements under various conditions. The experiments may be categorized as follows:

1. comparison of yarn properties of filament bundles that were divided and that were not divided into groups;
2. improvement of yarn properties upon increasing the number of filaments;
3. improvement of yarn properties by using a spinning bath with a high sulphuric acid content.

Each of these points will hereinafter be considered in detail. All the experiments were carried out on a special experimental machine. The spinning solutions were prepared by the so-called ice method (U.S. Pat. No. 4,320,081), in which sulphuric acid is cooled to below the melting point on a rotating drum. To the solid sulphuric acid scraped off PPDT is added, after which the two solid substances are thoroughly mixed. The molten sulphuric acid is absorbed by the polymer powder, as a result of which a sandy (solid) spinning mass is formed. The spinning mass is melted in a 60 mm single-screw extruder and filtered. The resulting anisotropic spinning mass is forwarded to the spinning unit by means of a spinning pump. After passage through an air zone coagulation takes place in a water bath provided with several variable or non-variable outlet openings. After the coagulation bath the yarn bundle is first washed with water (about 15° C.) and subsequently neutralized in a 1%-NaOH solution (about 80° C.) and after-washed with hot water (90° C.). Then the yarn is dried and wound up.

with several spinnerets which are represented in FIGS. 19–26.

Figure 19:
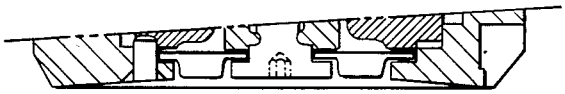
FIGS. 19–22 are cross-sectional views and side elevations of a spinning unit according to the invention with which experiments were carried out.
Figure 20:
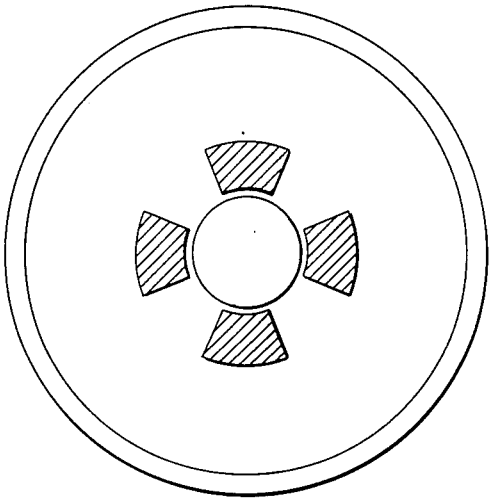

FIGS. 19, 20: ring spinneret (40/20 mm) with 4 fields of orifices (Experiment Codes PS 162/00,01,02).

Figure 21:
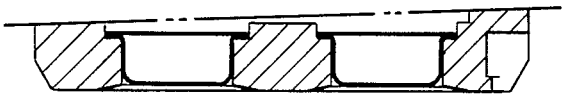
Figure 22:
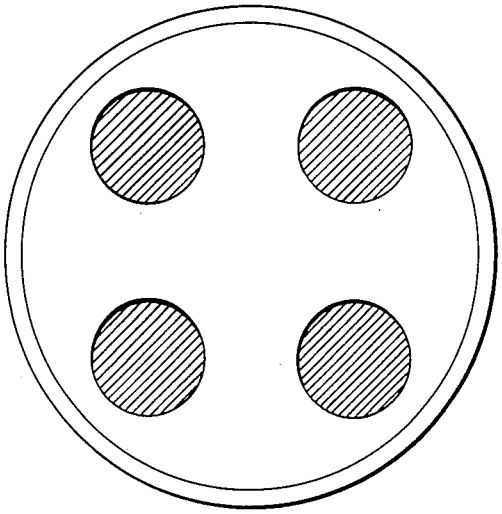

FIGS. 21, 22: 4×20 mm hat-shaped spinnerets (Experiment Codes 162/03,04).

Figure 23:
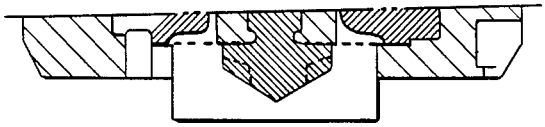
FIGS. 23 and 24 are a cross-sectional view and a side elevation of a prior art spinning unit with which a comparative experiment was carried out.
Figure 24:
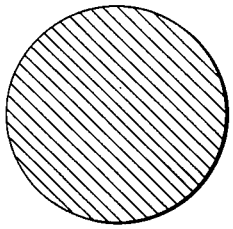

FIGS. 23, 24: 40 mm hat-shaped, one-field spinneret (Experiment Codes 162/05,06).

The zones hatched in FIGS. 20, 22 and 24 are provided with spinning orifices through which the filaments are extruded. Table 1 gives the spinning conditions and the yarn properties. From the data listed in it it appears that:

a diaphragm system has a favourable effect on the yarn strength;

the use of a 4 hat-shaped-spinneret has a more favourable effect on the strength than the ring spinneret;

spinning from a one-field hat-shaped-spinneret gives a lower strength, in which case a rather considerable spread in the yarn strength can be noticed. It was also found that stringing up (spinning in) is not possible in the case of a permanent passage way 12 mm in diameter. The 40 mm one-field spinneret was bent outward as a result of the polymer pressure, which did not happen in the case of the other spinnerets.

TABLE 1

Spinning conditions and yarn properties (average values of 10 runs). The total number of filaments in the bundle was 1000.

| Exp. code PS | Depth. of coag. bath (mm) | Outlet opening coat. bath | Throughput coag. bath (kg/h) | $H_2SO_4$* conc. in in (wt. %) | Type of spinnert | Tension after coag. bath (g) | Tension drier before (g) | Tension drier after (g) | Linear density (dtex) | Tenacity (mN/tex) | Elong. at break (%) | Max. modulus (mN/tex) |
|---|---|---|---|---|---|---|---|---|---|---|---|---|
| 16200 | 30 | 4 permanent stand. openings d = 12 mm | 1970 | 1,86 | FIG. 19,20 code 4360 | 490 | 225 | 200 | 200 | 1902 | 3,32 | 7138 |
| 16201 | 30 | 4 diaphragm openings d = 8 mm | 1110 | 2,38 | FIG. 19,20 code 4360 | 410 | 200 | 150 | 1728 | 1944 | 3,28 | 75050 |
| 16202 | 40 | 4 diaphragm openings d = 8 mm | 1260 | 2,23 | FIG. 19,20 code 4360 | 410 | 200 | 150 | 1733 | 2043 | 3,36 | 77270 |
| 16203 | 30 | 4 permanent stand. openings d = 12 mm | 2700 | 1,89 | FIG. 21,22 code 4338 | 510 | 250 | 300 | 1717 | 2038 | 3,21 | 73620 |
| 16204 | 30 | 4 diaphragm openings d = 8 mm | 1320 | 2,23 | FIG. 21,22 code 4338 | 400 | 240 | 230 | 1726 | 2076 | 3,37 | 71700 |
| 16205 | 30 | 1 permanent opening d = 24 mm | 2240 | 1,98 | FIG. 23,24 code 4339 | 400 | 200 | 250 | A 1712<br>B 1707 | 1898<br>1965 | 3,17<br>3,15 | 69890<br>71670 |
| 16206 | 30 | 1 permanent opening d = 16 mm | 1315 | 2,09 | FIG. 23,24 code 4339 | — | — | — | A 1708<br>B 1716 | 1802<br>1800 | 3,10<br>3,06 | 68410<br>68310 |
| 16207 | — | 1 permanent opening d = 12 mm | | | | does not permit stringing up | | | | | | |

*concentration of the spin solution to coag. bath: 1.52% $H_2SO_4$

1. Comparing the yarn properties of divided and non-divided filament bundles

These experiments were carried out at a winding speed of 300 m/min and using a spinning solution containing 19.6% PPDT in sulphuric acid (99.8%).

The relative viscosity of the polymer in sulphuric acid (96%, 25° C.) was $\eta_{rel}$ 0.25%=4.58 which corresponds to an inherent viscosity $\eta_{inh}$ 0.5%=5.5. In these spinning experiments use was made of a spinning unit 2. Improvement of the yarn properties when spinning 2000 filaments per spinning unit On the spinning machine used in the experiment the maximum number of filaments spun per spinning unit is 1000 (4 bundles of 250 filaments). When this number is increased, the strength of the yarn is considerably reduced. For a fair comparison the strength was always determined on a bundle of 1000 filaments (viz. dtex 1680 f 1000). The decrease in strength is illustrated in Table 2, which shows that doubling the number from 1000 to 2000 filaments per spinning unit leads to a loss of strength of 150–200 mN/tex (Compare PS 13606 with 13601 and PS 15500 with 15501). The results in Table 2 also show that with 2000 filaments the same strength level can be attained as with 1000 filaments, when the diaphragm system according to the invention is used (see codes PS 15502 and 15503).

A strength level of 2034 mN/tex (measured on a dtex 1680 f 1000 bundle) in the case of 2000 filaments per spinning unit must be considered a favourable result.

TABLE 2

Spinning conditions and yarn properties when spinning a bundle comprising in all 1000 or 2000 filaments wound in the form of 2 yarns each composed of 1000 filaments.

Figure 25:
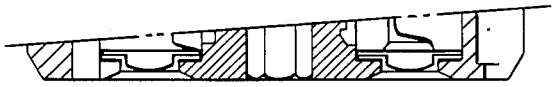
FIGS. 25 and 26 are also views of a spinning unit according to the invention.
Figure 26:
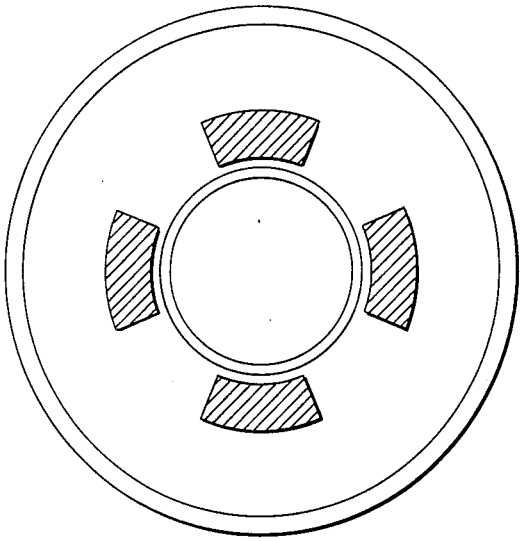

| Exp. code PS | Winding speed (m/min) | Type of spinning unit | bath depth (mm) | Number of filaments | Outlet opening coag. bath | Bath through-put (kg/h) | Linear density of 1000 filaments (dtex) | Strength (mN/tex) | Elong. at break (%) | LASE (1%) (N) |
|---|---|---|---|---|---|---|---|---|---|---|
| 13606 | 275 | FIG. 19,20 4360 | 30 | 1000 | 4 permanent openings d = 12 mm | 2120 | 1742 | 2116 | 3,43 | 92 |
| 13601 | 275 | FIG. 25,26 4330 | 30 | 2000 | 4 permanent openings d = 12 mm | 2450 | 1736 | 1945 | 3,54 | 80 |
| 15500* | 300 | FIG. 19,20 4360 | 30 | 1000 | 4 permanent openings d = 12 mm | — | 1711 | 2050 | 3,46 | 83 |
| 15501 | 300 | FIG. 21,22 4338 | 30 | 2000 | 4 permanent openings d = 12 mm | 2640 | 1725 | 1924 | 3,39 | 90 |
| 15502 | 300 | FIG. 21,22 4338 | 30 | 2000 | diaphragm d = 8 mm | — | 1725 | 2034 | 3,57 | 78 |
| 14403 | 300 | FIG. 21,22 4338 | 25 | 3000 | diaphragm d = 8 mm | 1362 | 1662 | 2016 | 3,50 | 78 |

*19,63% PPDT $\eta_{inh\ 0,5}$ = 5,4

3. Improvement of yarn properties by using a spinning bath with a high sulphuric acid content Up to now use has been made of a spinning bath with a low sulphuric acid content (sulphuric acid concentration below 5% by weight). Using a spinning bath containing 20% sulphuric acid will result in a decrease in strength of about 5%, which corresponds to a loss of strength of 100 mN/tex. From the series of experiments in Table 3 it appears that according to the invention the use of several filament groups and the so-called diaphragm system permits recovering part of this strength loss (see Exp. code PS 16107) also when use is made of a more highly concentrated spinning bath (15.3% by weight of $H_2SO_4$). This result, namely spinning into a more concentrated spinning bath without loss of strength, must be considered particularly favourable, especially in that it makes it possible to make a more economical use of sulphuric acid, which is also desirable for reasons of environmental protection. Moreover, for evaporating the spinning bath it is of great importance to have a concentrated bath. As appears from Table 3, the loss of strength can be limited. Even higher concentrate spinning baths, viz. containing more than 15% by weight of $H_2SO_4$, more particularly 21% by weight of $H_2SO_4$, make it possible to attain high yarn strengths by using two or more filament groups per spinning unit in combination with said diaphragm system according to the invention.

TABLE 3

Spinning conditions and yarn properties when spinning into a concentrated spinning bath (winding speed: 300 m/min; polymer content 19,39%; $\eta_{inh\ 0,5}$ = 5,5)

| Exp. code PS | Bath depth (mm) | Outlet opening coag. bath | Bath through-put (kg/h) | $H_2SO_4$ conc. spin. bath (wt. %) | Spinning unit code | Linear density (dtex) | Tenacity (mN/tex) | Elong. at break (%) | Max. modulus (mN/tex) |
|---|---|---|---|---|---|---|---|---|---|
| 16100 | 30 | 4 permanent openings d = 12 mm | 2070 | 15,4 | FIG. 19,20 4360 | 1729 | 1865 | 3,47 | 64750 |
| 16101 | 30 | 4 permanent openings d = 12 mm | 2640 | 15,4 | FIG. 21,22 4338 | 1736 | 1768 | 3,26 | 66026 |
| 16102 | 30 | 4 diaphragm openings d = 8 mm | 1490 | 15,7 | FIG. 21,22 4338 | 1737 | 1877 | 3,45 | 66900 |
| 16103 | 25 | 4 diaphragm openings d = 8 mm | 1280 | 15,8 | FIG. 21,22 4338 | 1737 | 1898 | 3,50 | 66000 |
| 16104 | 15 | 4 diaphragm openings d = 8 mm | 770 | 15,8 | FIG. 21,22 4338 | 1722 | 1971 | 3,56 | 67200 |
| 16105 | 15 | 4 diaphragm openings d = 6 mm | 870 | 15,9 | FIG. 21,22 4338 | 1719 | 1925 | 3,52 | 67000 |
| 16106 | 15 | 4 diaphragm openings d = 4 mm | 610 | 16,3 | FIG. 21,22 4338 | 1723 | 1927 | 3,61 | 66400 |
| 16107 | 20 | 4 diaphragm openings | 1110 | 15,5 | FIG. 21,22 4338 | 1728 | 2004 | 3,60 | 67550 |

TABLE 3-continued

Spinning conditions and yarn properties when spinning into a concentrated spinning bath (winding speed: 300 m/min; polymer content 19,39%; $\eta_{inh\,0,5}$ = 5,5)

| Exp. code PS | Bath depth (mm) | Outlet opening coag. bath | Bath through-put (kg/h) | $H_2SO_4$ conc. spin. bath (wt. %) | Spinning unit code | Linear density (dtex) | Tenacity (mN/tex) | Elong. at break (%) | Max. modulus (mN/tex) |
|---|---|---|---|---|---|---|---|---|---|
| | | d = 8 mm | | | | | | | |

The tenacity, the elongation at rupture and the LASE of the yarns were measured on a bundle of yarn made up of single filaments, use being made of an Instron tensile tester (Instron Engineering Corp., Canton, Mass., U.S.A.). The yarns are previously twisted to 90 t/m. Prior to all the measurements the yarns are conditioned for 16 hours at a temperature of 20° C. and a relative humidity of 65%. The measurements are carried out in an identically conditioned room. The tensile tests are carried out five fold on samples having a gauge length of 50 cm and at a constant tensile rate of 5 cm/min.

The linear density of the yarn is determined by weighing a particular length of sample (100 cm under a tension of 0.2 cN/dtex). LASE stands for "Load at Specified Elongation". The 1% LASE is a force acting in the yarn at an elongation of 1%.

When a PPDT filament yarn is spun by a conventional method, i.e. when for instance a bundle of in all 1000 filaments is extruded from a spinneret into the coagulation bath, i.e. without being divided into two or more filament groups and without a filament-free zone in the centre, a fairly deep funnel-shaped depression will form at the centre of the filament bundle, as a result of which the properties of the yarn are detrimentally affected.

It should be added that the inherent viscosity $\eta_{inh}$ of the poly-p-phenylene terephthalamide is defined by the formula $$\eta_{inh} = \frac{\ln \eta_{rel}}{0,5}$$

where $\eta_{rel}$ is the ratio of the efflux times of a solution of 0.5 g of poly-p-phenylene terephthalamide in 100 ml of 96% by weight-sulphuric acid and the pure solvent measured in a capillary viscometer at 25° C. The unit of $\eta_{inh}$ is deciliters per gram.

Within the scope of the invention various modifications may be made. It should be noted that the process according to the invention can be applied both to the manufacture of a filament yarn and staple fibres. In the manufacture of staple fibres the filaments, before or after being washed or dried, are cut into fibres of a particularly desired length, which fibres are then collected in the usual manner.

We claim:

1. A method of forming a plurality of distinct, separate fibers from an aromatic polyamide spinning mass comprising air-gap spinning the spinning mass in an apparatus having a. a forming means for forming the polymeric spinning mass into a plurality of fibers, said forming means including a spinneret having plurality of orifices; and b. a contacting means for contacting the newly-formed fibers with a liquid, said contacting means comprising a container for holding a quantity of the liquid; the container having an aperture for withdrawal of the contacted fibers, the aperture in the container being openable to a first, large open areea for beginning the spinning operation, and reducible to a second, small open area for continuing the spinning operation; said contacting means being adapted to provide an air-gap between said forming means and the liquid;

said spinning including the steps of (1) providing the aperture in its first, large open area mode for passing the initial spinning product through the aperture to effect greater ease in stringing up said filaments and (2) reducing the aperture to its second, small open area for restricting the flow of the liquid through the aperture during the continuation of said spinning to form filaments of greater tenacity.

2. The method of claim 1 wherein the aromatic polyamide comprises an aromatic para-polyamide.

3. The method of claim 2 wherein the aromatic para-polyamide comprises poly-p-phenyleneterephthalamide.

4. The method of claim 3 wherein the polymer used in the spinning mass is free of hexamethylphosphoramide or its decomposition products.

5. A method of air-gap spinning a plurality of distinct, separate synthetic fibers from an aromatic polyamide spinning mass, comprising a. forming the spinning mass into a plurality of fibers;

b. passing the newly-formed fibers through an air-gap; and c. passing the fibers through a liquid, the liquid being held in a container, the container having an aperture for the withdrawal of the fibers, the aperture being opened to a first, large open area for beginning the spinning operation, including passing the initial spinning mass through the aperture to effect greater ease in stringing up said filaments and being reduced to a second, small open area to restrict the flow of the liquid through the aperture during the continuation of the spinning operation to form filaments of greater tenacity.

6. The method of claim 5 wherein more than 1000 fibers are formed.

7. The method of claim 5 wherein the first, large open area is at least 5 times larger than the second, small open area.

8. The method of claim 5 wherein the second, small area is from 100·A to 5000·A, wherein A is the cross-sectional area of the filament bundle in the dried state.

9. The method of claim 5 wherein the fibers are formed by a spinneret having a plurality of orifices arranged in a plurality of separate zones.

10. The method of claim 9 wherein the spinneret has a total of more than 1000 orifices.

11. The method of claim 9 or 10 wherein there are at least 3 zones.

12. The method of claim 5 wherein the liquid comprises water.

13. The method of claim 12 wherein the water contains more than 5 weight percent sullphuric acid.

14. The method of claim 5 or 13 wherein the fibers exit the aperture at a speed of at least 250 m/min.

15. The method of claim 14 wherein the fibers exit the aperture at a speed of at least 350 m/min.

16. The method of claim 5 wherein the polymeric mass is an aromatic polyamide.

17. The method of claim 16 wherein the aromatic polyamide is poly-p-phenyleneterephthalamide.

18. The method of claim 17 wherein the polymer use in the spinning mass is free of hexamethylphosphoramide or its decomposition products.

* * * * *